US005918347A

United States Patent [19]

Morawetz

[11] Patent Number: 5,918,347

[45] Date of Patent: Jul. 6, 1999

[54] MOTOR VEHICLE DOOR LOCK FOR USE WITH MOTOR VEHICLE DOOR HINGE

[75] Inventor: Richard Morawetz, Wuppertal, Germany

[73] Assignee: Ed. Scharwächter GmbH & Co. KG, Remscheid, Germany

[21] Appl. No.: 08/879,009

[22] Filed: Jun. 19, 1997

[30] Foreign Application Priority Data

Jul. 3, 1996 [DE] Germany ..... 196 26 704

[51] Int. Cl.[6] ..... F05D 11/02; F05D 11/06

[52] U.S. Cl. ..... 16/322; 16/334; 16/374; 16/274

[58] Field of Search ..... 16/322, 332, 334, 16/274, 321, 374

[56] References Cited

U.S. PATENT DOCUMENTS

| | | | |
|---|---|---|---|
| 4,575,898 | 3/1986 | Carlson | 16/274 |
| 5,317,785 | 6/1994 | Kobayashi | 16/322 |
| 5,412,842 | 5/1995 | Riblett | 16/334 |

FOREIGN PATENT DOCUMENTS

| | | | |
|---|---|---|---|
| 0220579 | 5/1987 | European Pat. Off. | 16/334 |
| 3538727 | 5/1987 | Germany | 16/321 |
| 8701355 | 1/1989 | Netherlands | 16/332 |
| 404854 | 1/1934 | United Kingdom | 16/322 |

*Primary Examiner*—Chuck Y. Mah
*Assistant Examiner*—Donald M. Gurley
*Attorney, Agent, or Firm*—Anderson, Kill & Olick, P.C.

[57] ABSTRACT

A motor vehicle door lock for use with a motor vehicle door hinge having two hinge halves connectable, respectively, with two parts of a door assembly, a door and a door pillar, and pivotally connected with each other by a hinge pin, the door lock including a cylinder housing fixedly connectable with one of the two hinge halves connectable with one part of the door assembly, a cylinder stem received in the cylinder housing and fixedly connectable with another of the two hinge halves connectable with another part of the door assembly, and at least one locking member arranged in the cylinder housing or the cylinder stem with a possibility of a radial adjustment.

19 Claims, 3 Drawing Sheets

MOTOR VEHICLE DOOR LOCK FOR USE WITH MOTOR VEHICLE DOOR HINGE

BACKGROUND OF THE INVENTION

1. Field of the Invention

The present invention relates to a motor vehicle door lock for use with a motor vehicle door hinge and, in particular, to a door lock which is formed integrally with the door hinge, with the door hinge having two hinge halves connectable, respectively, with two parts of the door assembly, a door and a door pillar, and pivotally connected with each other by a hinge pin, and with the door lock including at least one locking member associated with one of the two hinge halves, and a brake and locking element associated with another of the two hinge halves and cooperating with the locking member for locking the door in a predetermined opening position.

2. Description of the Prior Art

There exist a multiplicity of embodiments of a door lock of the type described above. A first embodiment, in which the door lock is combined with the door hinge and is releasably connected with the door hinge, is characterized by including a C- or U-shaped torsional spring which is fixedly connected with one of the hinge halves or a similar part and cooperates with an indexing segment secured to another of the hinge halves or a similar part. All of the door locks of this type, independent of their particular construction, have a common drawback which consists in that their functional elements are basically exposed and, therefore, can inadvertently be covered with varnish during varnishing of the vehicle body. This may adversely affect the operation of the door lock. Further, the exposed condition of the door lock elements can lead to their contamination as a result of abrasion and exposure to dirt.

Door locks, in which the locking member associated with one of the door assembly parts cooperates with a locking element secured to another of the door assembly parts, has the same drawback. In these door locks, at least the locking member is exposed and, thus, is subjected to the same damage and contamination as the elements of a door lock with a torsion spring. Besides, both types of the door lock are suitable only for the doors the maximal opening angle of which is less than 90°. The third embodiment of the door lock, which is combined with the door hinge, is characterized in that the locking member is provided on an extension of the hinge axis which projects beyond the hinge pin. In the door locks of this type, there exists a possibility to protect the functional elements of the door lock with additional cover elements and, thereby, at least partially eliminate the drawback which characterized the door locks of the two embodiment discussed previously. However, providing these additional cover elements is connected with increased manufacturing and assembly costs. In addition, the door locks provided with cover elements require an increased mounting space which makes their use very problematic.

All of the conventional door locks are further characterized in that their locking force is determined constructively and, therefore, cannot be changed, which makes the adjustment of the functions or the characteristics of a door lock, after it has been installed, impossible.

Accordingly, an object of the present invention is a door lock for use with a motor vehicle door hinge and, in particular, a door lock which is formed integrally with the door hinge and, ignore particularly, with a demountable door hinge and which would have as small dimensions as possible even at the maximum door opening angle of 270°.

Another object of the invention is an improved door lock of the above-described type and which is closed so that varnishing of the vehicle body does not adversely affect the functioning of the door lock, on one hand, and on the other hand, the operation of the door and/or of the door locks does not lead to the door lock contamination.

A further object of the invention is a door lock of the above-described type the locking force of which can be adjusted at any moment during the mounting of the door hinge and/or the door lock in the vehicle body.

A still further object of the present invention is a door lock of the above-described type the adjustment of the locking force of which can be effected at any moment during the mounting independently of whether the door lock is formed integrally with the door hinge or is a separate unit.

SUMMARY OF THE INVENTION

These and other objects of the present invention, which will become apparent hereinafter, are achieved by providing a door lock having a cylinder housing fixedly connectable with one of the two hinge halves connectable with one part of the door assembly, a cylinder stem received in the cylinder housing and fixedly connectable with another of the two hinge halves connectable with another part of the door assembly, and at least one locking member arranged in the cylinder housing or the cylinder stem with a possibility of a radial adjustment therein.

Mounting of a door lock in a closed cylindrical housing insures, along with very small dimensions, an absolutely sealed construction of the door lock, which excludes any adverse affect on the functioning of the door lock of the vehicle body varnishing and prevents any penetration into the door lock of possible abrasion particles and dirt. A particular advantage of the door lock according to the present invention consist in that it can be mounted as independently of the door hinge and be formed integrally with the door hinge. In the latter case, a respective hinge half can be formed with a cylinder housing. Further, the construction of the door lock according to the present invention provides for a simple and subsequent adjustment of the biasing force, which is applied to the brake and locking member, which insures the possibility of adjustment of the door lock after the manufacture of the vehicle.

In particular, it is advantageously contemplated, when the door lock is formed integrally with the door hinge, to from the cylinder housing by a roller-shaped head portion of the one of the two hinge halves, and to form the cylinder stem by an extension of the hinge pin extending through the roller-shaped head portion, with the at least one locking member being arranged in the cylinder housing, and with at least one brake and locking element, which cooperates with the locking member, being provided on a circumference of the cylinder stem.

According to a particular advantageous embodiment of the door lock according to the present invention, it is contemplated to provide for application to the locking element, which is adjustable at least in a radial, i.e., transverse to the hinge pin axis, direction, of a biasing force. To this end, the cylinder housing is provided with at least one radial bore for receiving a spring, preferably formed as a helical spring, which applies a radially directed biasing force to the adjustable locking member.

According to another advantageous embodiment of the inventive door lock, the cylinder housing has a circumferential wall having a circumferential region with a thickness sufficient for forming a radial bore therein for receiving the locking member and a loading spring for biasing the locking member.

For increasing the total locking force of the door lock in dependence, in particular, on the door weight, the cylinder housing is provided with a plurality of bores, which are arranged one after another in an axial direction for receiving, respectively, a plurality of locking members and loading springs for biasing the locking members, respectively.

In order to be able to effect, if necessary, a subsequent adjustment of the braking or locking force of the door lock, it is further contemplated to provide a plurality of setscrews for closing the plurality of radial bores, which setscrews simultaneously form adjustable abutments for the loading springs for biasing the locking member or members.

When the use of a plurality of separate spring-biased locking members, which are independent from each other, is envisaged it is contemplated, according to the present invention, to form the locking members as plate-shaped pieces which are radially adjustable with respect to the cylinder stem or to the hinge pin extension forming the cylinder stem. The cylinder housing in this case is provided with a plurality of radially extending, axial grooves for receiving the plate-shaped locking members which a spring-biased with a plurality of separate loading springs.

Independently of their respective shapes, the plate-shaped locking members may be provided either with a rounded locking edge, a projecting locking nose portion, or a roller body in the edge forming the locking part.

According to a further development of the present invention, the cylinder stem is provided with one or more indentations which are associated with one or more locking members and which form brake and locking element. The indentation(s) is (are) formed as axially extending groove(s). The number of the indentations or the axial grooves correspond to the number of contemplated door openings, with the separate locking positions of the door being determined by the spacing of the grooves in the cylinder stem. The full movement of the door at the beginning of the opening of the door is preferably insured by forming the first groove or indentation in the cylinder stem in the door opening direction with an increased circumferential width which provides for a free movement of the door in this opening region.

In order to provide for a stop limiting the opening of the door and cooperating with the door lock, there is provided in the cylinder housing a further radial bore for receiving a stop bolt. The cylinder stem has a partially annular radial groove which cooperates with the stop bolt for limiting opening movement of the door. The stop bold is formed as a spring bolt. The door lock further includes a setscrew for securing the stop bolt in the further radial bore.

For fixing the cylinder stem in the cylinder housing, there are provided, according to the invention, two closing plates for closing opposite ends of the cylinder housing. The closing plates form abutments for axially securing one of the two hinge halves on the hinge pin. When the door lock is formed integrally with the door hinge, at lease one of the closing plates is attached to the cylinder housing or the head portion of the hinge half, in which the hinge pin is received, with a screw bolt.

According to the present invention, for lubricating cooperating parts of the inventive door lock, the cylinder stem is provided with at least one radially extending axial oil groove, connected with a lubricant source provided at the free end side of the cylinder housing. The axial oil groove is formed in the cylinder stem circumference in a region located opposite to the indentation(s) which forms the brake and locking element cooperating with the locking member. When the door lock according to the present invention is formed integrally with a demountable door hinge, the hinge pin, which is formed as a cylinder stem, is form-lockingly connected with a respective hinge half. To this end, an axial portion of the hinge pin is provided with polygonal cross-section. This axial portion cooperates with a complementary section of the gudgeon bore of the respective hinge half. The form-locking connection prevents the hinge pin from rotation relative to the hinge half.

According to the present invention, when the door lock is formed separately from the door hinge at least one hinge half of which is formed as a sheet folded part, the cylinder housing is formed as a separate shape part, and the two closing plates provide for the attachment of the hinge halves to the respective door assembly part.

In addition, the door lock according to the present invention can be used independently of the door hinge. In this case, the cylinder stem is secured to one of the door assembly parts by conventional means, such as a pivoted bracket, and the cylinder housing is secured to another of the door assembly parts without a possibility of rotation relative thereto.

According to a yet further embodiment of the present invention, the cylinder housing is provided with an axial bore coaxial with a hinge axis for receiving the locking member. The extension of the hinge pin, which forms the cylinder stem, has a radial indentation forming a brake and locking element cooperating with the locking member.

The door lock may have a plurality of brake and locking elements forming indentations which are formed of following one another, in a rotational direction of the hinge pin, identical radially extending elevations and recesses formed in a circumference of the cylinder stem-forming extension of the hinge pin.

BRIEF DESCRIPTION OF THE DRAWINGS

The features and objects of the present invention will become more apparent, and the invention itself will be best understood from the following detailed description of the preferred embodiments when read with reference to the accompanying drawing, wherein.

DETAILED DESCRIPTION OF THE PREFERRED EMBODIMENT

Figure 2:
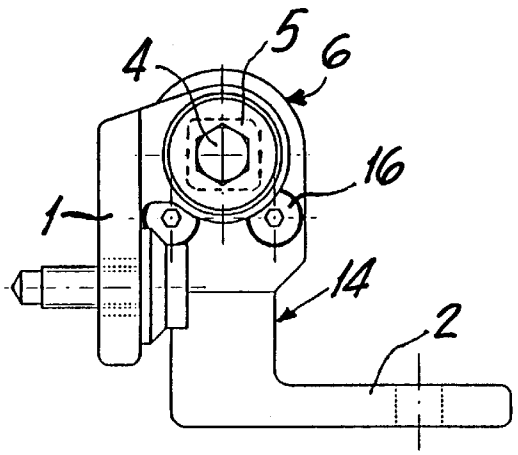
FIG. 2 shows a side view of the door hinge shown in FIG. 1.
Figure 3:
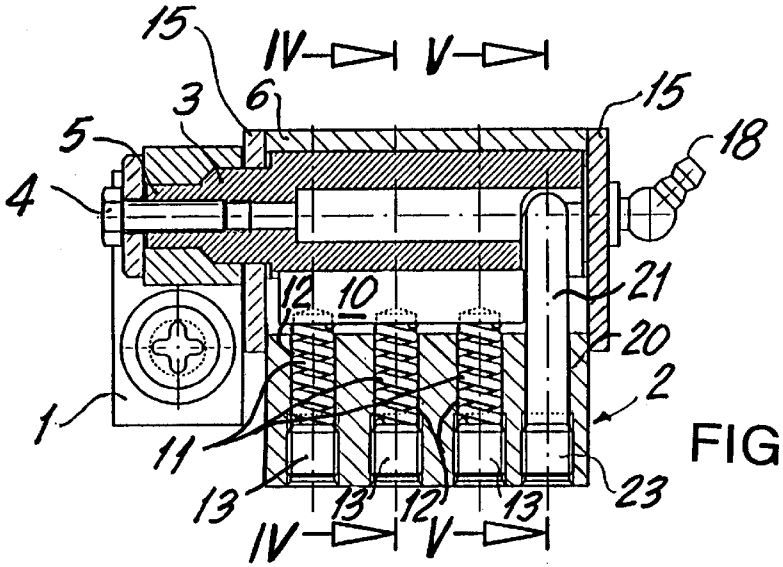
FIG. 3 shows a longitudinal cross-sectional view of the door hinge shown in FIG. 1.
Figure 1:
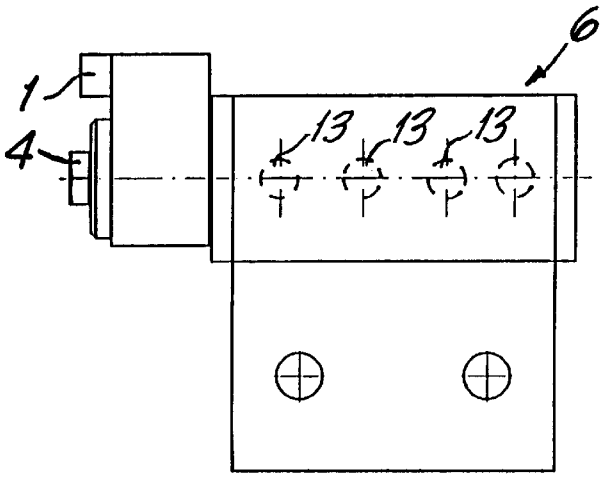
FIG. 1 shows a door hinge with an integrated door lock according to the present invention.
Figure 5:
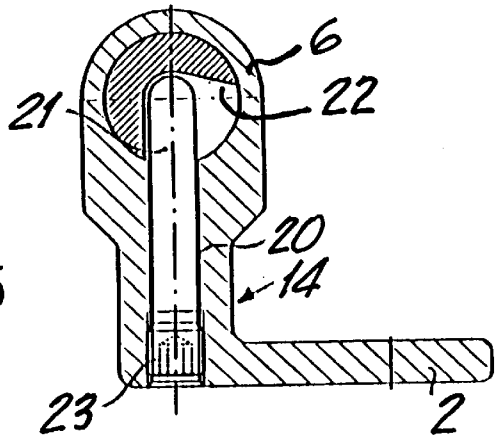
FIG. 5 shows a cross-sectional view of the door hinge shown in FIG. 3 along line V—V.
Figure 7:
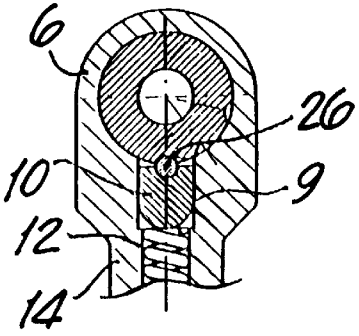
FIG. 7 shows a cross-sectional view of a second embodiment of a locking member of the door lock shown in FIG. 1.
Figure 6:
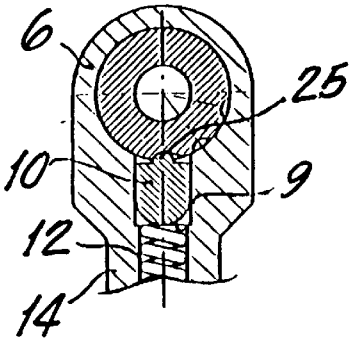
FIG. 6 shows a cross-sectional view of a first embodiment of a locking member of the door lock shown in FIG. 1.
Figure 4:
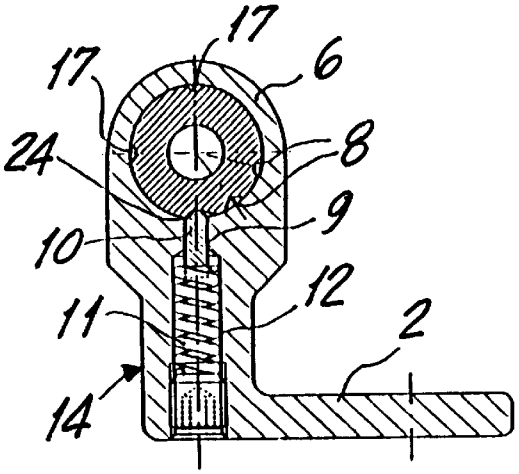
FIG. 4 shows a cross-sectional view of the door hinge shown in FIG. 3 along line IV—IV.
Figure 9:
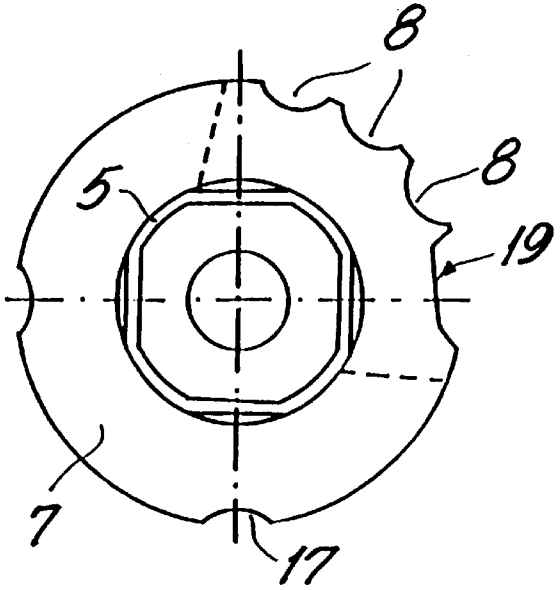
FIG. 9 shows a cross-sectional view of a first embodiment of a cylinder stem.
Figure 8:
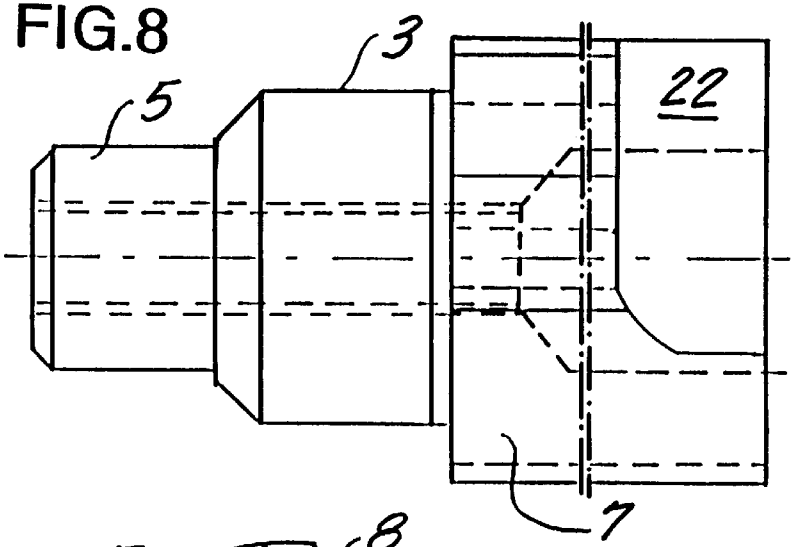
FIG. 8 shows a schematic view of a hinge pin at an enlarge scale.
Figure 10:
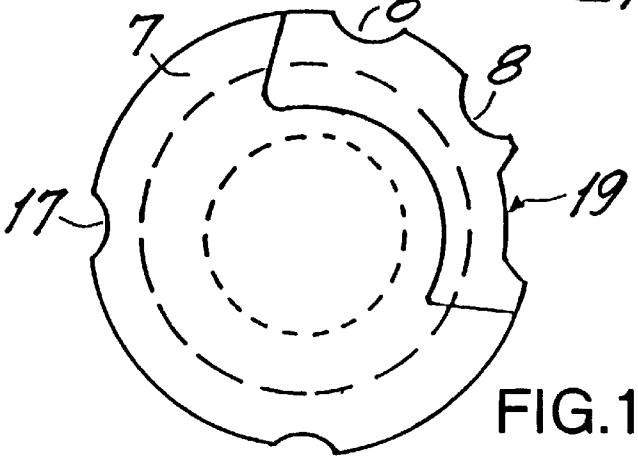
FIG. 10 shows a cross-sectional view of a second embodiment of a cylinder stem.

A motor vehicle door hinge, which includes a motor vehicle door lock according to the present invention as its integral part, includes of a first hinge half 1, which is secured to one part of a door assembly, a second hinge half 2, which is secured to another part of the door assembly, and a hinge pin 3 which is releasably connected with the first hinge half. A bolt 4 secures the hinge pin against the outer portion of to first hinge half 1, preventing the hinge-pin 3 from accidental falling out. To prevent rotation of the hinge pin 3 relative to the first hinge half 1, the hinge pin 3 is provided with a polygonal profile along a portion of its engagement length which cooperates with the complementary portion of the gudgeon bore of the first hinge half 1. The gudgeon bore of the head portion of the second hinge half 2 is formed as a cylinder housing 6 for receiving a portion of the hinge pin 3 having an increased diameter corresponding to the diameter of the cylinder housing 6 and formed as a cylinder stem 7. In the embodiment shown in the drawings, the cylinder stem 7 has a plurality of radially extending axial grooves which form brake and locking elements 8. The brake and locking elements 8 cooperate with a plate-shaped locking member 10 which is arranged in a radial groove 9 provided in the cylinder housing 6 and extends along a substantial portion of the length of the cylinder stem 7. The locking member 10 is biased in a radial direction by a plurality of loading springs 11 formed as helical springs. The loading springs 11 are received in respective bores 12, which are formed in the cylinder housing 6 and extend radially with respect to the cylinder stem 7. The loading springs 11 are supported in the bores 12 against respective setscrews 13 forming the bottoms of the bores 12. The bores 12, which are provided in the cylinder housing 6 correspond to the groove 9, which is formed in the cylinder housing 6 for receiving the locking member 10, and, in the embodiment shown, are provided in the roller-shaped region 14 of the angular second hinge half 2. The cylinder housing 6 is closed at its opposite ends with respective closing plates 15 which provide for the securing the hinge pin 3 in the second hinge half 2 and which are attached to the second hinge half 2 with screws 16 which are provided outside of the horizontal projection of the cylinder housing 6. The cylinder stem 7 is supported against the opposite closing plates 15 by means of intermediate sleeves. The cylinder stem 7, in its outer surface region opposite to the region in which brake and locking element-forming grooves 8 are provided, is provided with axial through oil grooves 17 which communicate with a lubricant source formed as a nipple 18 and arranged at the free end side of the cylinder housing 6. The number of the brake and locking element-forming grooves 8 provided in the cylinder stem 7 correspond to the number of contemplated stop positions of the door. E.g., the number of brake and locking element-forming grooves 8 provided in the cylinder stems 7, which are shown in FIGS. 9 and 10, respectively, three and two respectively, correspond to three and two stop positions of the door. In each case, a widened groove 19 adjoins the brake and locking element-forming grooves 8. The widened groove 19 insures a free movement of the door in the initial opening stage of the door opening. A spring bolt 21, which is located in a radial bore 20 formed in the cylinder housing 6, serves as a stop limiting the opening movement of the door. The spring bolt 21 is associated with a partially annular radial groove 22, which is formed in the cylinder stem 7 and cooperates with this groove so that it abuts the end of the groove 22 when the door reaches its maximal predetermined opening position. The spring bolt 21 is secured in the bore 21 of the cylinder housing 6 with a setscrew 23. As shown in FIG. 4, the plate, which forms the locking member 10, has a rounded edge 24. In the embodiment of FIG. 6, the plate, which forms the locking member 10, has a projecting nose 25. In the embodiment of FIG. 7, the locking member-forming plate is provided with a roller 26 which serves as locking body.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A motor vehicle door lock for use with a motor vehicle door hinge having two hinge halves connectable, respectively, with two parts of a door assembly, a door and a door pillar, and pivotally connected with each other by a hinge pin, said door lock comprising:

a cylinder housing fixedly connectable with one of the two hinge halves connectable with one part of the door assembly;

a cylinder stem received in said cylinder housing and fixedly connectable with another of the two hinge halves connectable with another part of the door assembly; and at least one locking member arranged in one of the cylinder housing and the cylinder stem with a possibility of a radial adjustment therein, wherein cylinder housing has a circumferential wall having a circumferential region with a thickness sufficient for forming a radial bore therein for receiving said locking member and a loading spring for biasing said locking member, and wherein said cylinder housing has a further radial bore for receiving a stop bolt, and said cylinder stem has a partially annular radial groove which cooperates with said stop bolt for limiting opening movement of the door, said stop bolt being formed as a spring bolt, said door lock further including a set screw for securing said stop bolt in said further radial bore.

2. A door lock as set forth in claim 1, wherein said cylinder housing has a plurality of bores, which are arranged one after another in an axial direction for receiving, respectively, a plurality of locking members and loading springs for biasing said locking members, respectively.

3. A door lock as set forth in claims 2, further comprising a plurality of setscrews for closing said plurality of bores, said setscrews forming adjustable abutments for said loading springs.

4. A door lock as set forth in claim 1, further comprising two closing plates for closing opposite ends of the cylinder housing, said closing plates forming abutments for axially securing the hinge pin with respect to the one of the two hinge halves.

5. A door lock as set forth in claim 1, wherein said cylinder stem has at least one radially extending indentation forming a brake and locking element cooperating with said locking member for locking the door in a predetermined opening position thereof.

6. A door lock as set forth in claim 5, wherein said cylinder stem has a plurality of radially extending indentations formed as axial grooves.

7. A door lock as set forth in claim 6, wherein the plurality of radially extending indentation formed in said cylinder stem corresponds to a number of locking positions of the door, with a first indentation arranged in a door opening direction having a width larger than a width of remaining indentations.

8. A door lock as set forth in claim 4, further comprising screw means for attaching at least one of said closing plate to said cylinder housing and located outside of a projection plane of said cylinder housing.

9. A door lock as set forth in claim 1, wherein the hinge pin is releasably received in another of the two hinge halves and is form-lockingly secured therein.

10. A motor vehicle door lock for use with a motor vehicle door hinge having two hinge halves connectable, respectively, with two parts of a door assembly, a door and a door pillar, and pivotally connected with each other by a hinge pin, said door lock comprising:

a cylinder housing fixedly connectable with one of the two hinge halves connectable with one part of the door assembly;

a cylinder stem received in said cylinder housing and fixedly connectable with another of the two hinge halves connectable with another part of the door assembly; and at least one locking member arranged in one of the cylinder housing and the cylinder stem with a possibility of a radial adjustment therein, wherein said cylinder housing is formed by a roller-shaped head portion of the one of the two hinge halves; and the cylinder stem is formed by an extension of the hinge pin extending through the roller-shaped head portion, wherein the at least one locking member is arranged in the cylinder housing, and at least one brake and locking element, which cooperates with said locking member, is provided on a circumference of said cylinder stem, and wherein said locking member is formed as a plate-shaped piece and is radially adjustable with respect to the cylinder stem, wherein said cylinder housing has a radially extending axial groove receiving said plate-shaped piece, and wherein said door lock further comprises a plurality of loading springs for biasing said locking member.

11. A door lock as set forth in claim 10, wherein said cylinder housing has a radial bore extending radially to said cylinder stem for receiving a spring for biasing said locking member toward said cylinder stem.

12. A door lock as set forth in claim 10, wherein said locking member-forming plate-shaped piece has a rounded locking edge.

13. A door lock as set forth in claim 10, wherein said locking member-forming plate-shaped piece has a projecting locking nose portion.

14. A door lock as set forth in claim 10 wherein said locking member-forming plate-shaped piece is provided with at least one roller body forming a locking part.

15. A door lock as set forth in claim 10, wherein said cylinder housing has an axial bore coaxial with a hinge axis for receiving said locking member, and said extension of the hinge pin, which forms said cylinder stem has a radial indentation forming a brake and locking element cooperating with said locking member.

16. A door lock as set forth in claim 10, further comprising a plurality of brake and locking element-forming indentations which are formed of following one another, in a rotational direction of the hinge pin, identical radially extending and recesses formed in a circumference of the cylinder stem-forming extension of the hinge pin.

17. A door lock as set forth in claim 16, wherein a first brake and locking element-forming indentation, which is arranged in a door opening direction, has a larger circumferential width than remaining brake and locking element-forming indentations in order to insure a free movement of the door through a first opening angle of door opening.

18. A door lock as set forth in claim 10, wherein said cylinder housing is formed as a separate part and is inserted between two profiled legs of the one of the two hinge halves formed as a sheet folded part.

19. A motor vehicle door lock for use with a motor vehicle door hinge having two hinge halves connectable, respectively, with two parts of a door assembly, a door and a door pillar, and pivotally connected with each other by a hinge pin, said door lock comprising:

a cylinder housing fixedly connectable with one of the two hinge halves connectable with one part of the door assembly;

a cylinder stem received in said cylinder housing and fixedly connectable with another of the two hinge halves connectable with another part of the door assembly; and at least one locking member arranged in one of the cylinder housing and the cylinder stem with a possibility of a radial adjustment therein, wherein the cylinder stem has a radially extending axial oil groove, and wherein said axial oil groove is formed in a circumference of the cylinder stem opposite an indentation forming a braking and locking element, said door lock further comprising a lubricant source connected with said oil groove.

* * * * *